US012017264B2

(12) United States Patent
Shingu et al.

(10) Patent No.: US 12,017,264 B2
(45) Date of Patent: Jun. 25, 2024

(54) ALUMINUM FOIL FOR ULTRAVIOLET LIGHT REFLECTING MATERIALS AND METHOD FOR PRODUCING SAME

(71) Applicant: TOYO ALUMINIUM KABUSHIKI KAISHA, Osaka (JP)

(72) Inventors: Akira Shingu, Osaka (JP); Mitsunari Ooyagi, Osaka (JP)

(73) Assignee: TOYO ALUMINIUM KABUSHIKI KAISHA, Osaka (JP)

( * ) Notice: Subject to any disclaimer, the term of this patent is extended or adjusted under 35 U.S.C. 154(b) by 803 days.

(21) Appl. No.: 16/085,224

(22) PCT Filed: Dec. 27, 2016

(86) PCT No.: PCT/JP2016/088915
§ 371 (c)(1),
(2) Date: Sep. 14, 2018

(87) PCT Pub. No.: WO2017/158989
PCT Pub. Date: Sep. 21, 2017

(65) Prior Publication Data

US 2019/0076897 A1 Mar. 14, 2019

(30) Foreign Application Priority Data

Mar. 16, 2016 (JP) ..... 2016-052230

(51) Int. Cl.
*B21B 1/26* (2006.01)
*B21B 1/28* (2006.01)
(Continued)

(52) U.S. Cl.
CPC ..... *B21B 1/26* (2013.01); *B21B 1/28* (2013.01); *B21B 1/38* (2013.01); *B21B 1/40* (2013.01);
(Continued)

(58) Field of Classification Search
CPC ..... B21B 1/22; B21B 2001/221; B21B 1/26; B21B 1/28; B21B 1/38; B21B 2001/383;
(Continued)

(56) References Cited

U.S. PATENT DOCUMENTS 5,919,561 A * 7/1999 Fuchs ..... C23C 28/00 428/912.2
5,978,133 A * 11/1999 Gillich ..... G02B 5/0833 359/359
(Continued)

FOREIGN PATENT DOCUMENTS

CN 1427959 A 7/2003
JP S59-157255 A * 9/1984 ..... C22C 21/06
(Continued)

OTHER PUBLICATIONS

"Surface Finish", 2015. DestinyTool. (Year: 2015).*
(Continued)

*Primary Examiner* — Adil A. Siddiqui
(74) *Attorney, Agent, or Firm* — Birch, Stewart, Kolasch & Birch, LLP

(57) ABSTRACT

Discussed is an aluminum foil for ultraviolet light reflecting materials, wherein a ratio of a total surface area of aluminum particles pressed into or adhering to a region having a predetermined surface area to the surface area of the region is less than or equal to 0.05%, the total surface area of crystallized products present in the region having a predetermined surface area is less than or equal to 2% with respect to the surface area of the region, an average surface area per crystallized product is less than or equal to 2 $\mu m^2$, and arithmetic surface roughness Ra of the region is less than 20 nm.

5 Claims, 6 Drawing Sheets

(51) Int. Cl.

| | |
|---|---|
| ***B21B 1/38*** | (2006.01) |
| ***B21B 1/40*** | (2006.01) |
| ***B21B 1/46*** | (2006.01) |
| ***B21B 3/00*** | (2006.01) |
| ***C22C 21/00*** | (2006.01) |
| ***C22C 21/08*** | (2006.01) |
| ***C22F 1/04*** | (2006.01) |

(52) U.S. Cl.
CPC ..... *B21B 1/46* (2013.01); *B21B 3/00* (2013.01); *C22C 21/00* (2013.01); *C22C 21/08* (2013.01); *C22F 1/04* (2013.01); *B21B 2001/383* (2013.01); *B21B 2003/001* (2013.01); *B21B 2261/04* (2013.01); *B21B 2261/14* (2013.01); *B21B 2267/10* (2013.01)

(58) Field of Classification Search
CPC ..... B21B 1/40; B21B 1/46; B21B 2003/001; B21B 2261/04; B21B 2261/14; B21B 3/00; B21B 2267/10; C22C 21/00; C22C 21/02; C22C 21/06; C22C 21/08; C22F 1/04; C22F 1/043; C22F 1/047; C22F 1/05; G02B 5/08; G02B 5/0891; G02B 5/0816; G02B 5/085; H01B 1/023
See application file for complete search history.

(56) References Cited

U.S. PATENT DOCUMENTS

| | | | | |
|---|---|---|---|---|
| 6,310,737 | B1 | 10/2001 | Gillich et al. | |
| 2004/0233530 | A1* | 11/2004 | Kramer | F21V 7/28 359/507 |
| 2010/0290021 | A1 | 11/2010 | Pazidis et al. | |
| 2013/0301151 | A1* | 11/2013 | Ekstein | G21K 1/062 359/838 |
| 2014/0261908 | A1* | 9/2014 | Seki | B22D 11/1206 148/551 |
| 2014/0342174 | A1* | 11/2014 | Tominaga | G02B 5/0808 428/551 |
| 2018/0017719 | A1* | 1/2018 | D'lallo | G02B 5/0833 |

FOREIGN PATENT DOCUMENTS

| | | | | |
|---|---|---|---|---|
| JP | 10-36985 | A | 2/1998 | |
| JP | 2002-322530 | A | 11/2002 | |
| KR | 2001-0032164 | A | 4/2001 | |
| WO | WO 2015/019960 | A1 | 2/2015 | |
| WO | WO-2015019960 | A1 * | 2/2015 | B21B 1/40 |

OTHER PUBLICATIONS

"Surface Roughness", 1994. Mitsubishi Carbide (Year: 1994).*
"Reflectance in Thin Films", 2011. Materion Microelectronics & Services (Year: 2011).*
"Properties of Wrought Aluminum and Aluminum Alloys," 1990. ASM Handbook, vol. 2, pp. 62-67. (Year: 1990).*
WO-2015019960-A1: Espacenet English machine translation (Year: 2015).*
Chinese Office Action and Search Report dated Nov. 13, 2019, for counterpart Chinese Patent Application No. 201680083442.4.
International Search Report (PCT/ISA/210) issued in PCT/JP2016/088915, dated Apr. 11, 2017.
Korean Decision for Grant of Patent for Korean Application No. 10-2018-7029403, dated Feb. 2, 2023, with an English Translation.

* cited by examiner

ALUMINUM FOIL FOR ULTRAVIOLET LIGHT REFLECTING MATERIALS AND METHOD FOR PRODUCING SAME

TECHNICAL FIELD

The present invention relates to an aluminum foil for ultraviolet light reflecting materials and a method for producing the same. In the present description, the term "aluminum foil" is used as a meaning including not only pure aluminum foil but also aluminum alloy foil.

BACKGROUND ART

There are various devices in which ultraviolet light is used. Among them, as a device for killing bacteria and the like, there is known an ultraviolet sterilization device including a deep ultraviolet lamp in which an ultraviolet sterilization effect is used. Because the ultraviolet light emitted from the deep ultraviolet lamp spreads radially, the ultraviolet light emitted from the deep ultraviolet lamp is preferably condensed around a specific sterilization target object in order to enhance the ultraviolet sterilization effect on the sterilization target object.

Aluminum (Al) is an only material having a high reflectance to the ultraviolet light in a wavelength range of 250 nm to 400 nm. A lightweight aluminum foil having high workability is suitable for the ultraviolet light reflecting material.

WO 2015/019960 (PTD 1) discloses an aluminum foil having a high reflectance in an entire range of visible light including a visible light region close to the ultraviolet region (for example, wavelengths of 380 nm to 600 nm).

CITATION LIST

Patent Document

PTD 1: WO 2015/019960

SUMMARY OF INVENTION

Technical Problems

However, when the present inventors measured the reflectance to the ultraviolet light in the wavelength range of 250 nm to 400 nm as a total reflectance of an integrating sphere with respect to the aluminum foil of PTD 1, the present inventors found that the reflectance is less than 85% and the light condensing effect is insufficient. In particular, the reflectance to the deep ultraviolet light in the wavelength range of 254 nm to 265 nm having a high ultraviolet sterilization effect is less than 80% at the maximum, and the light condensing effect was not sufficiently obtained.

An object of the present invention is to provide an aluminum foil for ultraviolet light reflecting materials having the high reflectance of greater than or equal to 85% to the ultraviolet light in the wavelength range of 250 nm to 400 nm and the high reflectance of greater than or equal to 80% to the deep ultraviolet light in the wavelength range of 254 nm to 265 nm, and a method for producing the aluminum foil.

Solution to Problems

As a result of extensive studies to solve the above problems, the present inventors have found that the reflectance to the ultraviolet light is improved when not only surface roughness but also crystallized products existing on a surface of an aluminum foil and aluminum particles existing by pressing-in or adhesion are controlled. That is, an aluminum foil for ultraviolet light reflecting materials and a method for producing the same of the present invention have the following features.

In the aluminum foil for ultraviolet light reflecting materials of the present invention, a ratio of a total surface area of aluminum particles pressed into or adhering to a region having a predetermined surface area to the surface area of the region is less than or equal to 0.05%. The total surface area of crystallized products present in the region is less than or equal to 2% with respect to the surface area of the region. An average surface area per crystallized product is less than or equal to 2 $\mu m^2$. Surface roughness Ra of the region is less than 20 nm.

In the aluminum foil for ultraviolet light reflecting materials, surface roughness $R_{ZJIS}$ in a direction perpendicular to a rolling direction is preferably less than or equal to 100 nm.

In the aluminum foil for ultraviolet light reflecting materials, a thickness of the aluminum foil is preferably greater than or equal to 4 μm and less than or equal to 300 μm.

The aluminum foil for ultraviolet light reflecting materials may include a protective layer formed on the region. A total reflectance of a surface of the protective layer to deep ultraviolet light in a wavelength range of 254 nm to 265 nm inclusive is greater than or equal to 80%.

In the aluminum foil for ultraviolet light reflecting materials, a material constituting the protective layer preferably contains at least one of a silicone composition and a fluororesin.

In the aluminum foil for ultraviolet light reflecting materials, surface roughness Ra of the surface of the protective layer is preferably less than or equal to 10 nm.

A method for producing the aluminum foil for ultraviolet light reflecting materials having the above features includes the step of performing final finish cold rolling on an aluminum foil at a rolling reduction ratio of greater than or equal to 25% using a rolling roll having surface roughness Ra of less than or equal to 40 nm.

The method for producing the aluminum foil for ultraviolet light reflecting materials having the above features preferably further includes the step of washing at least a part of a surface of the aluminum foil using an acid solution or an alkaline solution, or performing electrolytic polishing after the final finish cold rolling.

The method for producing the aluminum foil for ultraviolet light reflecting materials having the above features may further include the step of forming a protective layer containing at least one of a silicone composition and a fluororesin on at least a part of the surface after the final finish cold rolling step.

Advantageous Effects of Invention

According to the present invention, it is possible to provide the aluminum foil for ultraviolet light reflecting materials having a higher reflectance than the conventional aluminum foil.

DESCRIPTION OF EMBODIMENT

Figure 1:
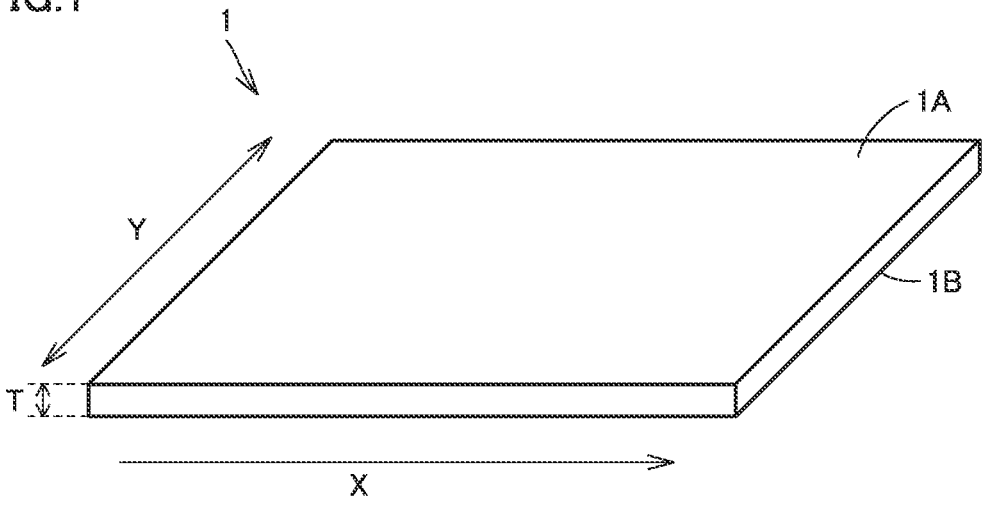
FIG. 1 is a perspective view illustrating an aluminum foil according to the present embodiment.

Hereinafter, an embodiment of the present invention will be described with reference to the drawings. In the following drawings, the same or corresponding component is designated by the same reference numeral, and the overlapping description will be omitted.

<Structure of Aluminum Foil>

In an aluminum foil 1 (see FIG. 1) of the present embodiment, a ratio of the total surface area of the aluminum particles, which exist in a region having a predetermined surface area and are pressed in or adhere to the region, to the surface area of the region is less than or equal to 0.05%. A ratio of the total surface area of the crystallized products existing in the region to the surface area of the region is less than or equal to 2%. An average surface area per crystallized product is less than or equal to 2 $\mu m^2$. Surface roughness Ra of the region is less than 20 nm.

The region having the predetermined surface area may be a whole surface of the aluminum foil or a part of the surface. As used herein, the surface of the aluminum foil means a surface that can be checked by visual observation, a microscope, or the like in appearance of the aluminum foil. Thus, the region having the predetermined surface area is a region in an observation visual field when the observation is performed with a microscope or the like. That is, the above parameters and surface roughness Ra, $R_{ZJIS}$ relating to the aluminum particles and the crystallized products are measured within the observation visual field of the predetermined surface area when the surface of the aluminum foil is observed with a microscope or the like. The total surface area of the aluminum particles is observed and measured within a predetermined observation visual field of, for example, a scanning electron microscope. The total surface area and average surface area of the crystallized products are observed and measured within a predetermined observation visual field of, for example, an optical microscope. Surface roughness Ra, $R_{ZJIS}$ is measured within a predetermined observation visual field of, for example, an atomic force microscope. The region having the predetermined surface area includes an observation visual field in measuring the total surface area of the aluminum particles, an observation visual field in measuring the total surface area and average surface area of the crystallized products, and an observation visual field in measuring surface roughness Ra, $R_{ZJIS}$.

Figure 2:
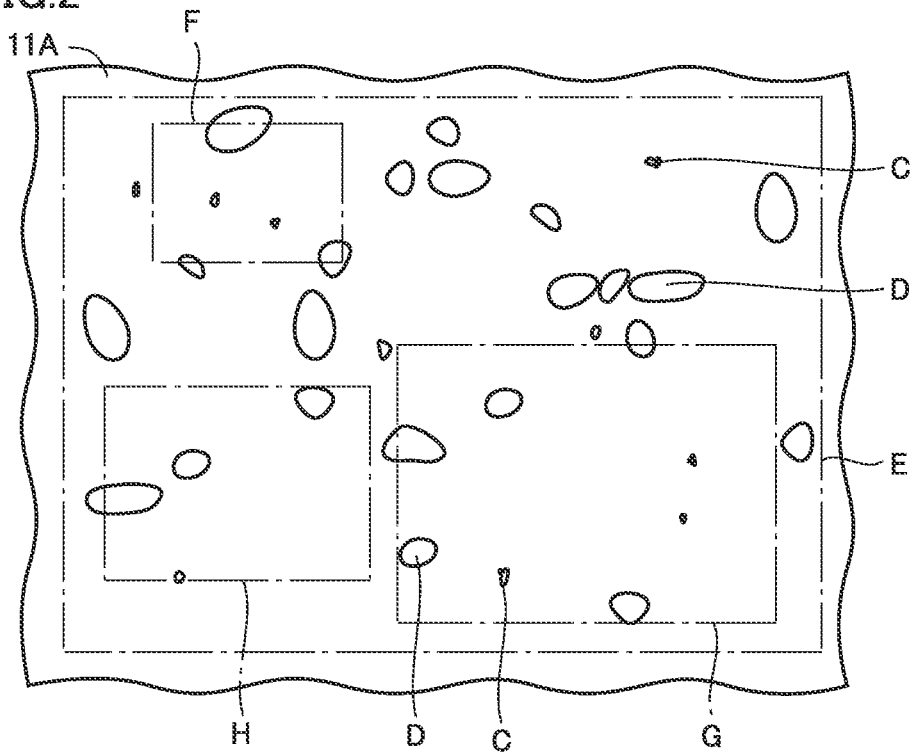
FIG. 2 is a plan view illustrating aluminum particles, crystallized products, and surface areas thereof.

As illustrated in FIG. 1, aluminum foil 1 includes a first main surface 1A and a second main surface 1B, which have the largest surface area out of the surfaces. FIG. 2 is a plan view illustrating a surface 11A (the surface to be first main surface 1A of aluminum foil 1 after surface washing) of a cold-rolled material 11 (see FIG. 5) before the surface washing in a method for producing the aluminum foil (to be described later). As illustrated in FIG. 2, for example, a predetermined region E is a part of first main surface 1A. A planar shape of region E may be any shape, for example, a rectangular shape. Region E includes an observation region F in the observation visual field at any magnification of the scanning electron microscope for measuring the total surface area of the aluminum particles, an observation region G in the observation visual field in measuring the total surface area and average surface area of the crystallized products, and an observation region H in the observation visual field in measuring surface roughness Ra, $R_{ZJIS}$. In each of observation regions F, G, H, the area and a position in region E can be selected in any manner. At least a part of each of observation regions F, G, H may or may not overlap each other.

Figure 3:
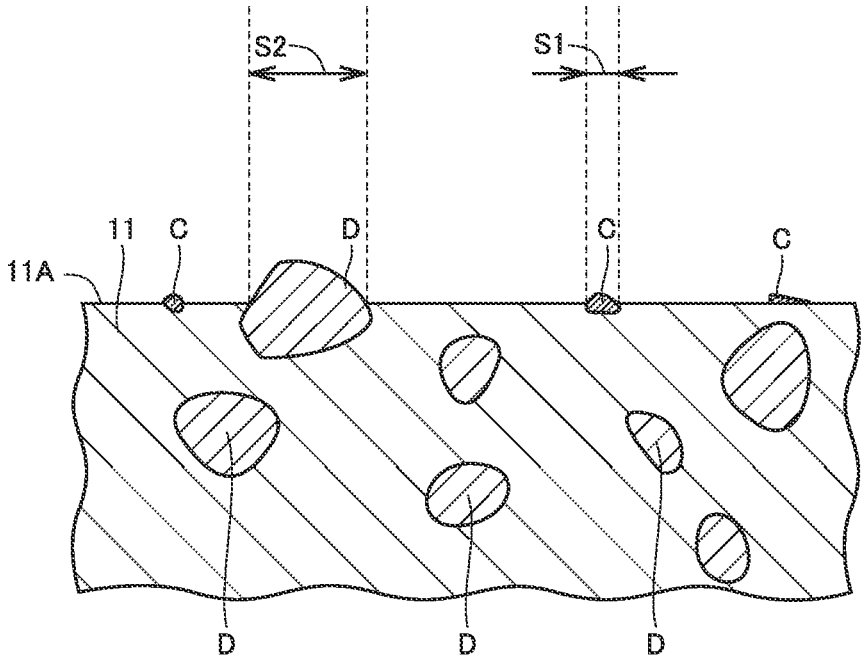
FIG. 3 is a sectional view illustrating aluminum particles, crystallized products, and surface areas thereof.

The aluminum particles consist mainly of aluminum (Al). For example, an outer diameter of the aluminum particles is several hundred nanometers to several micrometers. As illustrated in FIG. 3, aluminum particles C are pressed in or adhere to the surface of aluminum foil 1. Aluminum particle C is produced in a cold rolling process in the method for producing aluminum foil 1, to be described later. As illustrated in FIG. 3, the total surface area of aluminum particles C is a sum of projection areas S1 in which aluminum particles C, which are observed when observation region F is viewed from a direction (substantially perpendicular direction) in which an angle formed with respect to a surface (for example, first main surface 1A) having the observation region F is 90°±2°, are projected to a plane perpendicular to this direction.

The crystallized product means various intermetallic compounds such as Al—Fe, Al—Fe—Mn, Al—Mg—Si, and Al—Mn based materials. As illustrated in FIG. 3, the total surface area of crystallized products D is a sum of projection areas S2 in which crystallized products D, which are observed when observation region G is viewed from a direction (substantially perpendicular direction) in which the angle formed with respect to a surface (for example, first main surface 1A) having the observation region G is 90°±2°, are projected to a plane perpendicular to this direction. The average surface area per crystallized product is obtained by dividing the total surface area of crystallized products D by the number of crystallized products D existing in the observation region G.

Surface roughness Ra of aluminum foil 1 is a value calculated by extending arithmetic average roughness Ra defined in JIS B 0601 (2001 version) and ISO 4287 (1997 version) to three dimensions in order to apply the arithmetic average roughness Ra to the surface.

The aluminum foil is cold-rolled in the method for producing the aluminum foil. Consequently, a transfer stripe (not illustrated) of a rolling roll extending along a rolling direction X (see FIG. 1) is formed on the surface (first main surface 1A and second main surface 1B) of the aluminum foil. Irregularities caused by transfer stripes are formed on the surface of the aluminum foil. The irregularities on the surface of the aluminum foil formed by the transfer stripes having a certain size or greater generate anisotropy in a reflection angle of an ultraviolet light and cause irregular reflection of reflected light. Consequently, a portion in which the transfer stripes having a size larger than a certain value are formed in the aluminum foil has low reflectance to the ultraviolet light. The irregularities caused by the transfer stripes of the rolling roll can be evaluated as a value of surface roughness $R_{ZJIS}$ in a direction Y perpendicular to rolling direction X, namely, in a TD direction.

In region E, surface roughness $R_{ZJIS}$ in direction Y (see FIG. 1) perpendicular to rolling direction X of aluminum foil 1 is preferably less than or equal to 100 nm. More preferably, surface roughness $R_{ZJIS}$ in region E is less than or equal to 80 nm. Surface roughness $R_{ZJIS}$ in perpendicular direction Y is a value in which two-dimensional surface roughness $R_{ZJIS}$ in a section along perpendicular direction Y is measured by an evaluation method based on JIS B 0601 (2001 version) and ISO 4287 (1997 version). Examples of a method for obtaining surface roughness Ra, $R_{ZJIS}$ include polishing such as physical polishing, electrolytic polishing, and chemical polishing, and cold rolling using a rolling roll having a mirror surface. The cold rolling using the rolling roll having the mirror surface will be described later.

A thickness T (see FIG. 1) of aluminum foil 1 is preferably greater than or equal to 4 μm and less than or equal to 300 μm. When the thickness of the aluminum foil is less than 4 μm, the aluminum foil cannot maintain mechanical strength, and wrinkle is generated on the surface of the aluminum foil by handling or the like during production. When the thickness of the aluminum foil exceeds 300 μm, not only weight of the aluminum foil increases but also the processing such as molding is restricted. More preferably, the thickness of aluminum foil 1 is greater than or equal to 6 μm and less than or equal to 250 μm. In order to set the thickness of the aluminum foil within the above range, casting and rolling may be performed according to a typical method for producing the aluminum foil.

The composition of aluminum foil 1 of the present embodiment is not particularly limited, but an Fe content is preferably greater than or equal to 0.001 mass % and less than or equal to 0.5 mass %. Because solid solubility of Fe in aluminum is small, the intermetallic compounds such as $FeAl_3$ tend to be crystallized during aluminum casting. These crystallized products have low reflectance to the ultraviolet light compared with an aluminum base, and cause a decrease in ultraviolet reflectance as the aluminum foil. When the whole added Fe is crystallized for the Fe content greater than or equal to 0.5 mass %, a crystallized amount of $FeAl_3$ as the Al—Fe based intermetallic compound exists over 1.2 mass %, and ultraviolet total reflectance of 250 nm to 400 nm tends to be lower than 85%. Consequently, the Fe content is desirably less than or equal to 0.5 mass %. When the Fe content is less than 0.001 mass %, the strength of the aluminum foil tends to decrease.

In the aluminum foil of the present embodiment, a Mn content is preferably less than or equal to 0.5 mass %. Because the solid solubility of Mn in aluminum is small similarly to Fe, Al—Fe—Mn based compounds and the like are easily crystallized during the aluminum casting. The Al—Fe—Mn based crystallized product is finer than the Al—Fe based crystallized product, and these crystallized products have the low reflectance to the ultraviolet light compared with the aluminum base, which causes a decrease in the ultraviolet reflectance as the aluminum foil. When the whole added Mn is crystallized for the Mn content greater than or equal to 0.5 mass %, the Al—Fe—Mn based intermetallic compound exists over 1.5 mass %, and the ultraviolet total reflectance of 250 nm to 400 nm tends to be lower than 85%. For this reason, the Mn content is desirably less than or equal to 0.5 mass %.

A Si content in the aluminum foil of the present embodiment is preferably greater than or equal to 0.001 mass % and less than or equal to 0.3 mass %. Because Si has a large solid solubility in aluminum to hardly form the crystallized product, the reflectance of the ultraviolet light is not degraded as long as the Si content is a content in which the crystallized products are not generated in the aluminum foil. When Si is contained, the mechanical strength of the aluminum foil is improved by solid solution strengthening, so that the rolling of the thin foil can be facilitated. When the Si content is less than 0.001 mass %, the above effect tends to be insufficiently obtained. When the Si content exceeds 0.3 mass %, coarse crystallized products are easily generated, and not only the reflection characteristic is degraded but also a refining effect of crystal grains is impaired, so that strength and workability tend to be degraded.

A Mg content in the aluminum foil of the present embodiment is preferably less than or equal to 3 mass %. Mg has the solid solubility in aluminum as large as 18 mass % at the maximum, and the generation of the crystallized products is extremely small, so that the mechanical strength of the aluminum foil can be improved without significantly affecting the reflection characteristic of the aluminum foil. However, when the Mg content exceeds 3 mass %, the mechanical strength of the aluminum foil becomes too high, so that rollability of the aluminum foil tends to decrease. In order to combine the preferable reflection characteristic and mechanical strength of the aluminum foil, the Mg content is more preferably less than or equal to 2 mass %.

The aluminum foil of the present embodiment may contain elements such as copper (Cu), zinc (Zn), titanium (Ti), vanadium (V), nickel (Ni), chromium (Cr), zirconium (Zr), boron (B), gallium (Ga), and bismuth (Bi) by a content that does not affect the above characteristic and effect.

<Method for Producing Aluminum Foil>

Figure 4:
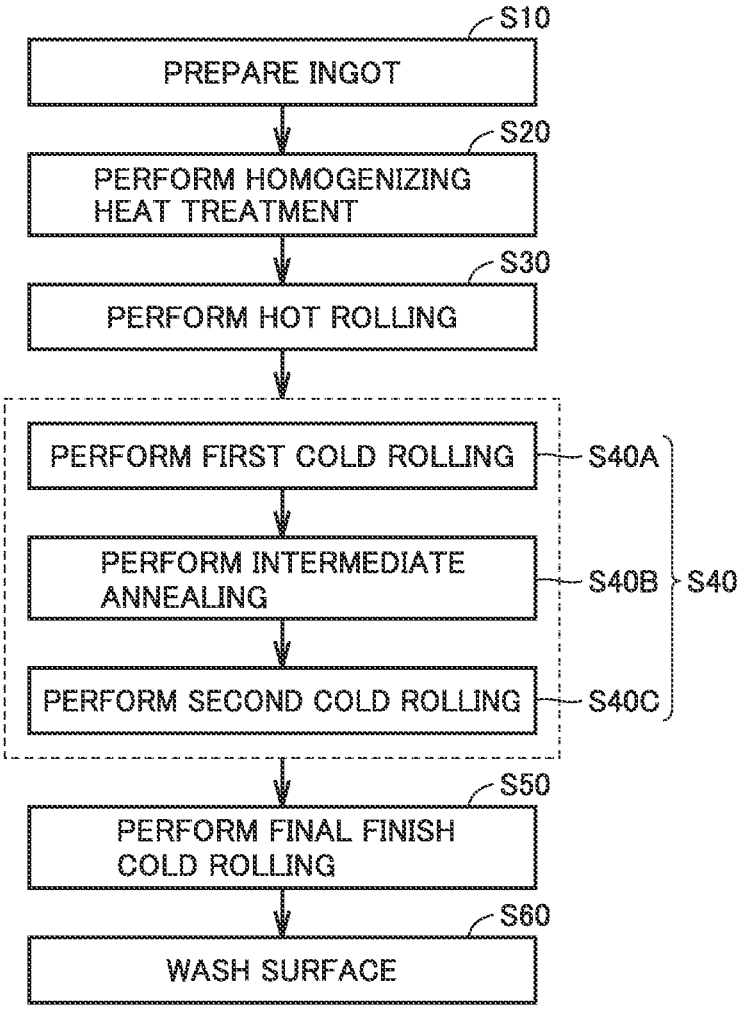
FIG. 4 is a flowchart of a method for producing the aluminum foil of the present embodiment.

An example of the method for producing the aluminum foil of the present embodiment will be described below. As illustrated in FIG. 4, the method for producing the aluminum foil of the present embodiment includes a step of preparing an ingot (S10), a step of homogenizing the ingot (S20), a step of hot-rolling the ingot (S30), a step of cold-rolling the hot-rolled material obtained by the hot rolling (S40), and a step of cold-rolling (hereinafter, referred to as final finish cold-rolling) the cold-rolled material obtained by the cold rolling as the final finish to form the aluminum foil (S50). The method for producing an aluminum foil of the present embodiment preferably includes a step of washing the surface of the cold-rolled material obtained by the final finish cold-rolling (S60).

First, an ingot is prepared (step (S10)). Specifically, a molten aluminum having a predetermined composition is prepared, and the molten aluminum is solidified to cast the ingot (for example, semi-continuous casting). The contents of the metal elements such as Fe, Mn, and Si in the molten aluminum is controlled such that the total surface area of the crystallized products existing in the region having the predetermined surface area in the aluminum foil is less than or equal to 2% with respect to the surface area of the region, and such that the average surface area per crystallized product is less than or equal to 2 $\mu m^2$.

Subsequently, homogenizing heat treatment is performed on the obtained ingot (step (S20)). The homogenizing heat treatment is performed under a condition that, for example, a heating temperature is greater than or equal to 400° C. and less than or equal to 630° C. and a heating time is greater than or equal to 1 hour and less than or equal to 20 hours.

Subsequently, the ingot is hot-rolled (step (S30)). A hot-rolled material having a predetermined thickness W1 is obtained through step S30. The hot rolling may be performed once or a plurality of times. In the case where a thin-plate aluminum ingot is produced by continuous casting, the thin-plate aluminum ingot may be subjected to the cold rolling without performing step S30.

Subsequently, the hot-rolled material obtained by the hot rolling is cold-rolled (step (S40)). A cold-rolled material (a rolled material in the final finish cold rolling step (S50)) having a predetermined thickness W2 is obtained through step S40. In step S40, the cold rolling is performed a plurality of times with, for example, an intermediate annealing step interposed therebetween. For example, a first cold rolling step (S40A) is performed on the hot-rolled material to form a rolled material that is thinner than thickness W1 of the hot-rolled material and thicker than thickness W2 of the cold-rolled material. Subsequently, the obtained rolled material is subjected to the intermediate annealing step (540B). The intermediate annealing is performed under the condition that, for example, the annealing temperature is greater than or equal to 50° C. and less than or equal to 500° C. and the annealing time is greater than or equal to 1 second and less than or equal to 20 hours. Subsequently, a second cold rolling step (S40C) is performed on the rolled material subjected to the annealing to form the cold-rolled material having thickness W2.

Figure 5:
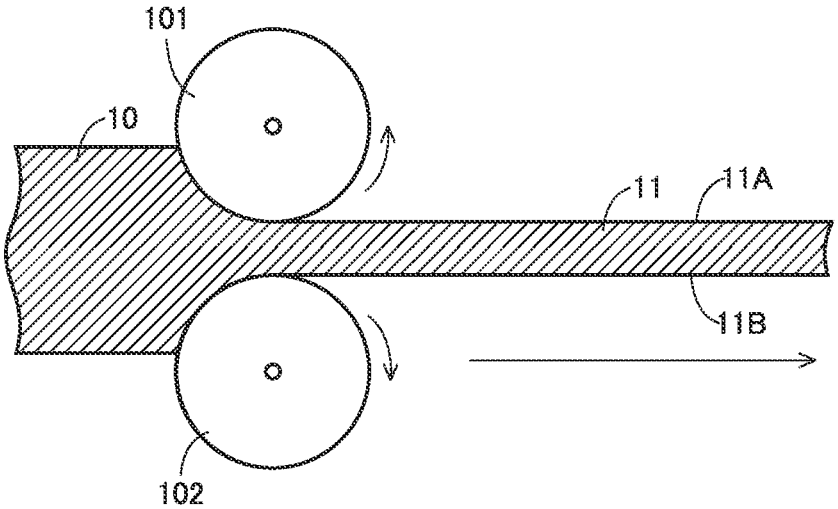
FIG. 5 is a sectional view illustrating cold rolling in the method for producing the aluminum foil of the present embodiment.

Subsequently, as illustrated in FIG. 5, the cold-rolled material (rolled material 10) is subjected to the final finish cold rolling (step (S50)). In step S50, rolled material 10 is subjected to the final finish cold rolling using rolling rolls 101, 102 under the condition that a rolling reduction ratio is greater than or equal to 25%. Rolling rolls 101, 102 have a roll surface which comes into contact with and rolls the rolled material. In the pair of rolling rolls 101, 102 disposed with rolled material 10 sandwiched therebetween, surface roughness Ra of the roll surface of rolling roll 101 is less than or equal to 40 nm.

A type of the rolling oil used for the final finish cold rolling is not particularly limited, but a rolling oil preferably has a low viscosity. When an oil temperature is 37.8° C. (100° F.), the viscosity of the rolling oil is preferably greater than or equal to 1.7 cSt and less than or equal to 3.5 cSt, more preferably greater than or equal to 2.0 cSt and less than or equal to 3.0 cSt.

Subsequently, the surface of cold-rolled material 11 (see FIG. 5) obtained by the final finish cold rolling may be washed (step (S60)). In step S60, at least a part of the surface of cold-rolled material 11 is washed using an acidic solution or an alkaline solution. The surface to be washed in cold-rolled material 11 includes surface 11A (see FIG. 5) extended by rolling roll 101 (see FIG. 5) having surface roughness Ra of less than or equal to 40 nm in the final finish cold rolling step (S50). The acidic solution may be selected from strongly acidic solutions such as hydrofluoric acid, phosphoric acid, hydrochloric acid, and sulfuric acid. The alkaline solution can be selected from strongly alkaline solutions such as sodium hydroxide. Other conditions for the surface washing can be selected as appropriate.

In this way, aluminum foil 1 of the present embodiment in FIG. 1 can be obtained. Region E of aluminum foil 1 is a region formed on the surface (for example, first main surface 1A) formed by the rolling with the rolling rolls having surface roughness Ra of less than or equal to 40 nm in the final finish cold rolling step (S50) and a region on the surface (for example, first main surface 1A) formed by the washing in the surface cleaning step (S60) after the rolling. That is, region E is not limited to the case where the region is formed on first main surface 1A of aluminum foil 1, but region E may be formed only on second main surface 1B, or on both first main surface 1A and second main surface 1B.

Effects

The inventors of the present invention confirmed that aluminum foil 1 has a high reflectance to the ultraviolet light in the wavelength range of 250 nm to 400 nm compared with a conventional aluminum foil (see details described later in Example).

The aluminum particles pressed into or adhering to the surface of the aluminum foil are produced in the cold rolling step (including the cold rolling step (S40) and the final finish cold rolling step (S50)) during the method for producing the aluminum foil. Specifically, as illustrated in FIG. 5, when rolled material 10 (hot-rolled material or cold-rolled material) is plastically deformed by the cold rolling and thinly extended, rolled material 10 undergoes shear deformation at the same time. Consequently, a part of the surface of rolled material 10 is torn during the cold rolling, and the aluminum particles (not illustrated) having outer diameters of several hundred nanometers to several micrometers are generated. The aluminum particles are sandwiched between rolling rolls 101, 102 and the aluminum material, whereby the aluminum particles are pressed into cold-rolled material 11 or re-adhere to surfaces 11A, 11B of cold-rolled material 11 after the rolling. At this point, when aluminum particles covered with an oxide film are pressed into or re-adhere to cold-rolled material 11, the ultraviolet light incident on the surface of the aluminum foil is considered to be irregularly reflected by or interfere with the aluminum particles or the oxide film. The present inventors have found that the reflectance of the aluminum foil to the ultraviolet light decreases when the aluminum particles exist on the surface of the aluminum foil as in the case where a ratio of the total surface area of the aluminum particles to the predetermined surface area in the aluminum foil exceeds 0.05%.

On the other hand, in aluminum foil 1, the total surface area of the aluminum particles, which exist in the region having the predetermined surface area and are pressed into or adhere to the region, is less than or equal to 0.05% with respect to the surface area of the region. For this reason, it is considered that aluminum foil 1 has a high reflectance to the ultraviolet light because the irregular reflection and interference caused by the aluminum particles are suppressed.

The reflectance of the ultraviolet light incident on the surface of the crystallized product is lower than the reflectance of the ultraviolet light incident on the surface of the aluminum. Consequently, the reflectance of the aluminum foil to the ultraviolet light decreases when the crystallized products exist on the surface of the aluminum foil as in the case where the total surface area of the crystallized products existing in the region having the predetermined surface area in the aluminum foil exceeds 2% with respect to the surface area of the region. When the average surface area per crystallized product exceeds 2 $\mu m^2$, unevenness of reflectance to the ultraviolet light becomes larger in the surface of the aluminum foil.

The crystallized products existing on the surface of the aluminum foil cause the irregularities on the surface of the aluminum foil. In particular, when the crystallized products exist on the surface of the rolled material (cold-rolled material) to be subjected to the final finish cold rolling, the crystallized products are harder than the aluminum base, so that aluminum preferentially undergoes plastic deformation. The crystallized product rolls on the surface of the plastically-deformed aluminum foil, and a part of the crystallized product falls from the surface of the aluminum foil to cause the irregularities on the surface of the aluminum foil. For this reason, a degree of causing the irregularities on the surface of the aluminum foil increases when the crystallized products exist on the surface of the aluminum foil as in the case where the total surface area of the crystallized products exceed 2% with respect to the surface area. A recess formed when the crystallized product falls from the surface of the aluminum foil becomes large when the average surface area per crystallized product exceeds 2 $\mu m^2$. As a result, the ultraviolet light incident on the surface of the aluminum foil is irregularly reflected at an irregular portion formed on the surface of the aluminum foil, so that the reflectance is lowered.

On the other hand, in aluminum foil 1, the total surface area of the crystallized product existing in the region having the predetermined surface area is less than or equal to 2% with respect to the surface area of the region. For this reason, aluminum foil 1 has the high reflectance to the ultraviolet light. In aluminum foil 1, the average surface area per crystallized product existing in the region is less than or equal to 2 $\mu m^2$. For this reason, the unevenness of the reflectance to the ultraviolet light is suppressed in aluminum foil 1.

When surface roughness Ra is greater than or equal to 20 nm, the reflectance of the aluminum foil to the ultraviolet light is lowered due to the irregularities on the surface. Based on a natural law, when incident ultraviolet light is reflected on a certain surface having the irregularities, a reflection angle changes depending on an incident point. In some cases, the light reflected by a certain irregular portion further strikes on (enters) an irregular portion existing next to the irregular portion, and there is a possibility of causing the reflection a plurality of times. It is known that the reflected light attenuates in one-time reflection. When the light is reflected a plurality of times, the reflectance of the light decreases by the number of reflection times.

On the other hand, when surface roughness Ra in the region having the predetermined surface area is less than 20 nm, the irregularities on the surface of the aluminum foil are reduced, so that a situation can be prevented in which the ultraviolet light reflected from the irregularities on the surface of the aluminum foil strikes on another irregular portion again to attenuate the reflected light. In aluminum foil 1, surface roughness $R_{ZJIS}$ in direction Y (see FIG. 1) is preferably less than or equal to 100 nm. This enables the irregularities on the surface of the aluminum foil to be further reduced, so that a situation can be further prevented in which the ultraviolet light reflected from the irregularities on the surface of the aluminum foil strikes on another irregular portion again to attenuate the reflected light.

The method for producing the aluminum foil of the present embodiment may include a surface washing step. In the surface washing step, the aluminum particles pressed into or adhering to the surface of the cold-rolled material (aluminum foil) in the final finish cold rolling step can be dissolved in an acidic solution or an alkaline solution and removed or reduced. Consequently, the aluminum foil in which the total surface area of the aluminum particles, which exist in the region having the predetermined surface area and are pressed in or adhere to the region, is less than or equal to 0.05% to the surface area of the region can easily be produced in the method for producing the aluminum foil of the present embodiment.

The reason why the rolling roll having surface roughness Ra of less than or equal to 40 nm in the final finish cold rolling step of method for producing the aluminum foil of the present embodiment is as follows. Surface roughness of the rolling roll used in the final finish cold rolling step greatly influences surface roughness of the aluminum foil obtained after the final finish cold rolling step. When the aluminum foil is rolled using the rolling roll having surface roughness Ra of more than 40 nm, the obtained aluminum foil has surface roughness $R_{ZJIS}$ of greater than 100 nm in the direction Y perpendicular to the rolling direction X, and surface roughness Ra also becomes greater than or equal to 20 nm. Surface roughness Ra of the rolling roll used in the final finish cold rolling step is preferably as small as possible, more preferably less than or equal to 30 nm.

The reason why the rolling reduction ratio in the final finish cold rolling process is greater than or equal to 25% is as follows. Generally, an amount of rolling oil film being caught between the rolling roll and the rolled material tends to increase when the rolling reduction ratio is lowered. Consequently, when the final finish cold rolling is performed at the low rolling reduction ratio, the rolling oil is pushed into the surface of the rolled material, whereby a plurality of oil pits having depths of several tens to several hundreds nanometers are formed on the surface. As a result, many irregularities due to the oil pits are formed on the surface of the obtained cold-rolled material. In particular, when the rolling is performed at the rolling reduction ratio of less than 25%, surface roughness Ra of the obtained aluminum foil is greatly influenced by the irregularities due to the oil pits, and becomes greater than or equal to 20 nm. The irregularities formed on the surface of the rolled material due to oil pits may cause the generation of the aluminum particles. When the rolling reduction ratio in the final finish cold rolling step is set greater than or equal to 25%, surface roughness Ra of the aluminum foil can be suppressed and the attenuation of the reflected light due to the irregularities on the surface of the aluminum foil can be prevented. When the rolling reduction ratio in the final finish cold rolling step is set greater than or equal to 25%, the generation of the aluminum particles can be prevented and the decrease in reflectance due to aluminum particles can be prevented. An upper limit of the rolling reduction ratio is not particularly limited, but is preferably 60%. At a rolling reduction ratio of greater than or equal to 60%, not only rollability is poor but also shearing force increases during rolling, and the generation of aluminum particles increases.

The reason why the rolling oil used in the final finish cold rolling step preferably has lower viscosity is as follows. Lubrication of the rolling oil provided between the rolling roll and the aluminum foil is enhanced as the viscosity of the rolling oil is lowered, and the oil pit formed due to pushing of the rolling oil into the surface of the aluminum foil during the final finish cold rolling step is hardly generated. Consequently, surface roughness Ra of the cold-rolled material obtained through the final finish cold rolling step can be lowered to prevent the generation of the aluminum particles. In particular, using the rolling oil having the viscosity greater than or equal to 1.7 cSt and less than or equal to 3.5 cSt at the oil temperature of 37.8° C. (100° F.) for the final finish cold rolling, surface roughness Ra of the obtained cold-rolled material can further be lowered to prevent the generation of the aluminum particles. Using the rolling oil having the viscosity greater than or equal to 2.0 cSt and less than or equal to 3.0 cSt at the oil temperature of 37.8° C. (100° F.) for the final finish cold rolling, surface roughness Ra of the obtained cold-rolled material can further be lowered to prevent the generation of the aluminum particles.

Modifications

Figure 6:
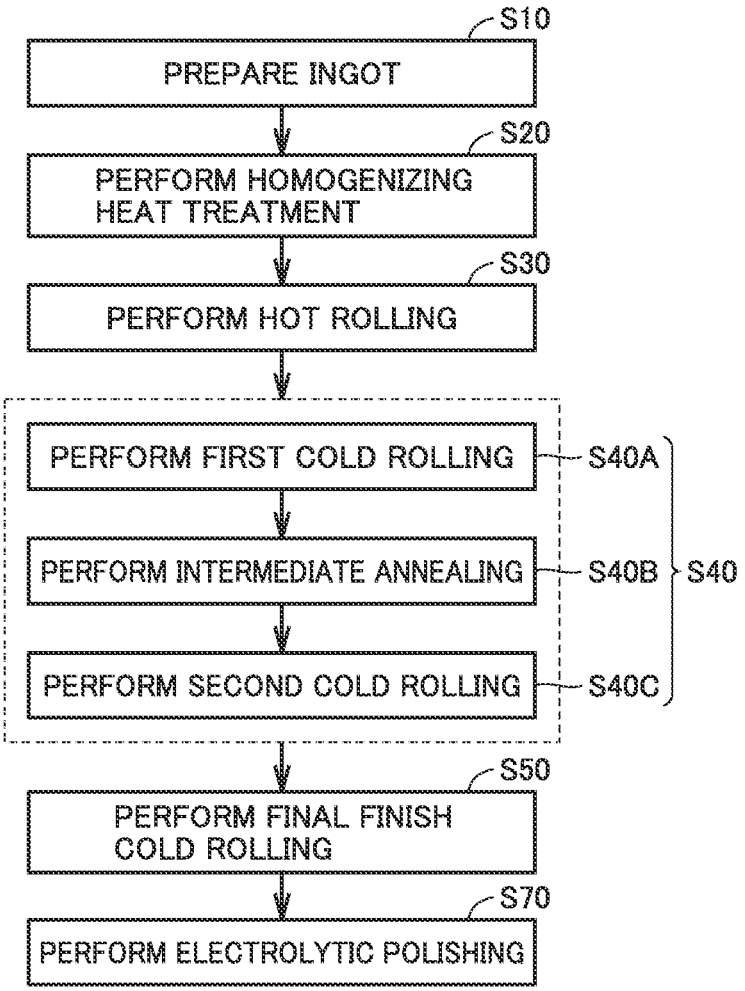
FIG. 6 is a flowchart illustrating a modification of the method for producing the aluminum foil of the present embodiment.

As illustrated in FIG. 6, instead of the surface washing step (S60) in FIG. 4, the method for producing the aluminum foil may include a step (S70) of performing electrolytic polishing on the surface of cold-rolled material 11 (see FIG. 5) obtained by the final finish cold rolling. The electrolytically-polished surface of cold-rolled material 11 includes surface 11A (see FIG. 5) extended by rolling roll 101 (see FIG. 5) having surface roughness Ra less than or equal to 40 nm in the final finish cold rolling step (S50). Even in such cases, the aluminum particles pressed in or adhering to the surface of the cold-rolled material in the final finish cold rolling step can be polished by the electrolytic polishing and removed or reduced. Consequently, even with the method for producing the aluminum foil in FIG. 6, the aluminum foil in which the total surface area of the aluminum particles, which exist in the region having the predetermined surface area and are pressed in or adhere to the region, is less than or equal to 0.05% to the surface area of the region can be produced. Additionally, smoothness of the surface of the aluminum foil can be enhanced by the electrolytic polishing.

The method for producing the aluminum foil in FIG. 4 may further include a step of performing electrolytic polishing on the washed surface of the aluminum foil after the surface washing step (S60).

The method for producing the aluminum foil may further include a step of heating the aluminum foil after the surface washing step (S60) or the electrolytic polishing step (S70). For example, the aluminum foil may be subjected to heat treatment at a heating temperature of about greater than or equal to 250° C. and less than or equal to 450° C. and a heating time of about 1 hour to 30 hours. Consequently, the soft aluminum foil having a high reflectance to the ultraviolet light can be produced.

In the aluminum foil, only a part of the surface having the region of the predetermined surface area may be used as an ultraviolet light reflecting material, and the remaining of the surface of the aluminum foil may be fixed to another component.

In the aluminum foil, a protective layer (surface protective layer) protecting the surface may be formed on the surface having the region of the predetermined surface area.

Figure 7:
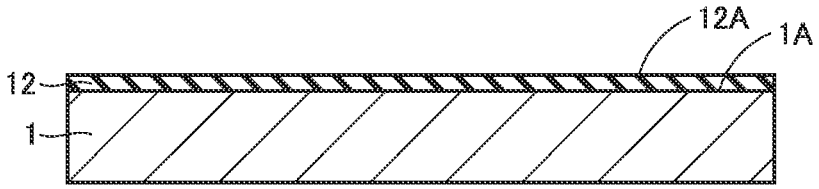
FIG. 7 is a sectional view illustrating a modification of the aluminum foil of the present embodiment.

As illustrated in FIG. 7, aluminum foil 1 may include a surface protective layer 12 on at least one surface (for example, first main surface 1A) having the region of the predetermined surface area. The total reflectance of a third main surface 12A that is the surface of surface protective layer 12 is greater than or equal to 80% with respect to deep ultraviolet light in the wavelength range of 254 nm to 265 nm.

For example, the material constituting surface protective layer 12 contains at least one of a silicone composition and a fluororesin. As used herein, the silicone composition means a material containing silicon (Si) and oxygen (O). The silicone composition may be crystalline or amorphous. For example, the silicone composition may be a crystalline silicon oxide. Organic materials, such as resin, which are contained in the material constituting surface protective layer 12 are preferably suppressed to less than or equal to a half of a total amount. Preferably, the material constituting surface protective layer 12 does not contain organic materials such as resin. Organic materials such as resin are decomposed when irradiated with the ultraviolet light. Consequently, when the organic material contained in surface protective layer 12 exceeds a half of the total amount, surface protective layer 12 is notably degraded with time when continuously irradiated with the ultraviolet light. On the other hand, when the organic material contained in surface protective layer 12 is less than or equal to a half of the total amount, surface protective layer 12 is not notably degraded when continuously irradiated with the ultraviolet light.

Preferably, surface protective layer 12 is transparent. When surface protective layer 12 is transparent, surface protective layer 12 does not greatly impair the reflection characteristic to the ultraviolet light on the surface of aluminum foil 1. Consequently, the reflectance of the deep ultraviolet light can be greater than or equal to 80% when third main surface 12A of surface protective layer 12 is irradiated with the deep ultraviolet light in the wavelength range of 254 nm to 265 nm.

Preferably, surface roughness Ra of third main surface 12A of surface protective layer 12 is less than or equal to 10 nm. As described above, based on the natural law, when the incident ultraviolet light is reflected on a certain surface having the irregularities, the reflection angle changes depending on an incident point. In some cases, the light reflected by a certain irregular portion further strikes on (enters) an irregular portion existing next to the irregular portion, and there is a possibility of causing the reflection a plurality of times. It is known that the reflected light attenuates in one-time reflection. When the light is reflected a plurality of times, the reflectance of the light decreases by the number of reflection times. Consequently, in the case where surface roughness Ra of third main surface 12A of surface protective layer 12 exceeds 10 nm, compared with the case where surface roughness Ra of third main surface 12A of surface protective layer 12 is less than or equal to 10 nm, the total reflectance of surface protective layer 12 may be notably lowered when third main surface 12A of surface protective layer 12 is irradiated with the deep ultraviolet light in the wavelength range of 254 nm to 265 nm.

Figure 8:
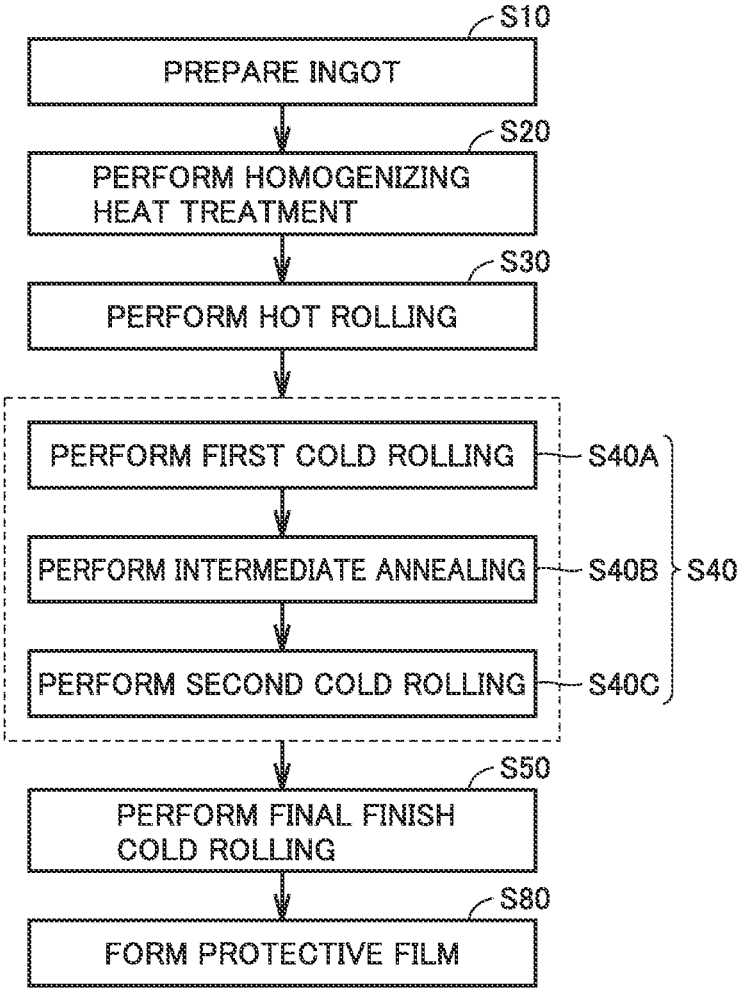
FIG. 8 is a flowchart illustrating a modification of the method for producing the aluminum foil of the present embodiment.
Figure 9:
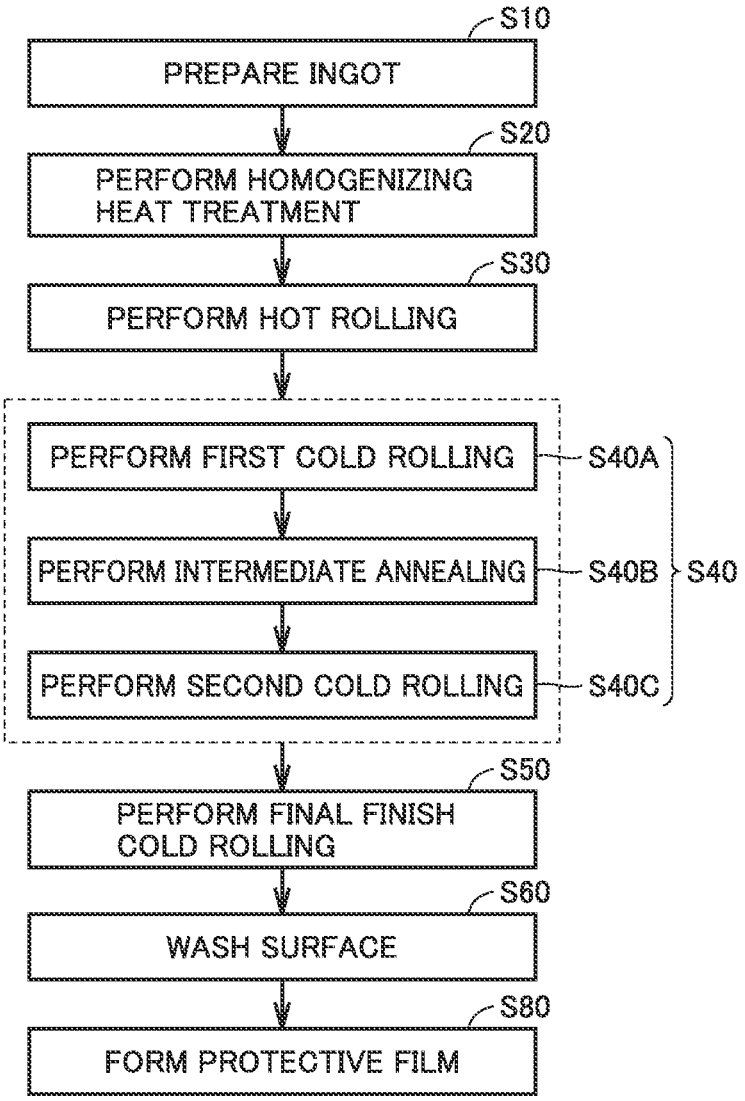
FIG. 9 is a flowchart illustrating a modification of the method for producing the aluminum foil of the present embodiment.

As illustrated in FIG. 8, a step of forming surface protective layer 12 (S80) can be performed after the final finish cold rolling step (S50). Preferably, as illustrated in FIG. 9, the step of forming surface protective layer 12 (S80) can be performed after the surface washing step (S60). Alternatively, the step of forming surface protective layer 12 (S80) can be performed after the electrolytic polishing step (S70). Surface protective layer 12 can be formed by any method. For example, surface protective layer 12 may be formed by bonding a film made of an any resin onto the surface of the aluminum foil. For example, surface protective layer 12 may be formed by applying any flowable resin on the surface of the aluminum foil and curing the resin. In surface protective layer 12, for example, an inorganic layer made of a silicon oxide ($SiO_2$) or the like may be formed on the surface of the aluminum foil by ion plasma, ion plating, sputtering, or vapor deposition. In the surface protective layer, for example, a metal layer made of nickel or the like may be formed on the surface of the aluminum foil by plating. The surface protective layer may be an oxide film layer formed by, for example, performing anodizing on the surface of the aluminum foil.

Figure 10:
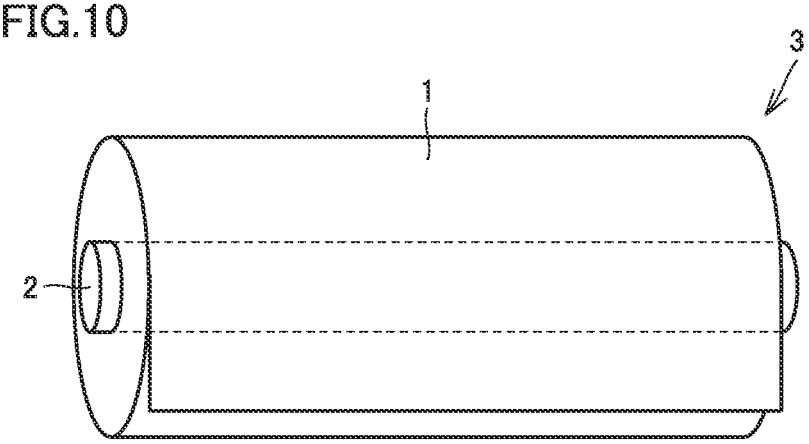
FIG. 10 is a perspective view illustrating roll-to-roll aluminum foil of the present embodiment.

The surface protective layer may be formed by, for example, a roll-to-roll process. In this case, as illustrated in FIG. 10, aluminum foil 1 may be wound into a roll shape around a winding core 2 to constitute a roll-to-roll aluminum foil 3.

The aluminum foil may be molded into any shape. For example, the aluminum foil may be molded by overhang molding or deep drawing molding, or formed into a shape suitable for a purpose by bending or curving.

In the aluminum foil, a wiring pattern may be formed on a part of the surface having the region of the predetermined surface area. For example, the wiring pattern can be formed as follows. First, the surface protective layer as an etching mask is formed on the remaining of the surface of the aluminum foil except for the part of the surface. Subsequently, a mask pattern as an etching mask is formed on the part of the surface of the aluminum foil. For example, the mask pattern is formed by photolithography of a photosensitive material such as a resist. Subsequently, etching is performed on the part of the surface of the aluminum foil under the condition that an etching selection ratio between aluminum and the mask pattern can be set larger.

As described above, the aluminum foil of the present embodiment is literally "foil", and has various advantages as follows unlike an "aluminum plate" which typically has a thickness greater than or equal to about 500 μm. That is, the aluminum foil has the advantage of excellent weight reduction and ease of forming, and also has the advantage of exhibiting shape followability or flexibility for adhesion of a curved product, the exhibition of the shape followability or flexibility being difficult for the aluminum plate. The aluminum foil also has the advantage in terms of an environmental burden such as leading to reduction of volume of waste compared with the aluminum plate.

Thus, the aluminum foil of the present embodiment is particularly advantageously applied to a reflector plate of an ultraviolet lamp used for sterilization of water and sea water, decomposition of organic materials, an ultraviolet light treatment, photocatalyst and resin curing by making use of the above advantages.

Example

Aluminum foil samples of Examples of the present invention and Comparative Examples were prepared as described below.

As illustrated in Table 3, aluminum foil samples of Examples 1 to 10 and aluminum foil samples of Comparative Examples 1 to 15 were prepared according to a producing process in Table 2 using aluminum having compositions A to E in Table 1. In Table 1, "total of other elements" means a total content of inevitable impurity elements such as B, Bi, Pb, and Na other than the elements defined by JIS.

TABLE 1

| | Chemical composition (mass %) | | | | | | |
|---|---|---|---|---|---|---|---|
| Composition | Si | Fe | Mn | Cu | Mg | Zn | Total of Other Elements |
| A | 0.002 | 0.002 | 0.006 | 0.001 | 0.000 | 0.001 | 0.002 |
| B | 0.140 | 0.450 | 0.020 | 0.000 | 0.001 | 0.005 | 0.000 |
| C | 0.138 | 0.442 | 0.020 | 0.003 | 0.001 | 0.008 | 0.070 |
| D | 0.241 | 0.416 | 1.090 | 0.145 | 1.161 | 0.050 | 0.150 |
| E | 0.080 | 1.470 | 0.000 | 0.005 | 0.001 | 0.000 | 0.030 |

TABLE 2

| Composition | Step 1 Homogenizing heat treatment | Step 2 Hot rolling | Step 3 Cold rolling | Step 4 Intermediate annealing | Step 5 Cold rolling |
|---|---|---|---|---|---|
| A | At temperature of 590° C. for 1 hour | Performed | Performed | — | Performed |
| B | | | | At temperature of 450° C. for 3 hours | |
| C | At temperature of 530° C. for 1 hour | | | | |
| D | At temperature of 590° C. for 10 hours | | | At temperature of 330° C. for 3 hours | |
| E | At temperature of 610° C. for 1 hour | | | At temperature of 390° C. for 3 hours | |

As illustrated in Table 2, in the producing process, an aluminum ingot obtained by direct casting (DC) was subjected to the homogenizing heat treatment at a predetermined temperature and time using a heating furnace. Then, the hot rolling was performed until the thickness of about 6.5 mm was obtained. The obtained hot-rolled material was subjected to the cold rolling a plurality of times, the intermediate annealing was performed at a predetermined temperature and time during the cold rolling, and the cold rolling (including final finish cold rolling) was performed until the thickness of a predetermined value was obtained, to prepare the aluminum foil sample having the thickness in Table 3. At this point, in Examples 1 to 10 and Comparative Examples 3 to 13, 15, the rolling was performed at the rolling reduction ratio of 25% using the rolling roll having surface roughness Ra of 40 nm in the final finish cold rolling. For Comparative Example 1, the rolling was performed at the rolling reduction ratio of 35% using the rolling roll having surface roughness Ra of 50 nm in the final finish cold rolling. For Comparative Examples 2 and 14, the rolling was performed at the rolling reduction ratio of 35% using the rolling roll having surface roughness Ra of 150 nm in the final finish cold rolling.

For Comparative Examples 5 to 8, 11 to 14, each evaluation to be described later was performed after the final finish cold rolling. For Examples 1 to 5, 7 to 10 and Comparative Examples 1, 2, 9, 10, and 15, after final finish cold rolling, the surface washing was performed by immersing the sample in a 1-weight-% sodium hydroxide aqueous solution at a liquid temperature of 35° C. for 20 seconds. For Example 6, after the final finish cold rolling, the surface washing was performed by immersing the sample in the 1-weight-% sodium hydroxide aqueous solution at the liquid temperature of 35° C. for 10 minutes. For Comparative Example 3, after the final finish cold rolling, the surface washing was performed by immersing the sample in the 1-weight-% sodium hydroxide aqueous solution at the liquid temperature of 35° C. for 2 seconds. For Comparative Example 4, after the final finish cold rolling, the surface washing was performed by immersing the sample in the 1-weight-% sodium hydroxide aqueous solution at the liquid temperature of 35° C. for 1 second.

The homogenizing heat treatment time may be within a typical processing time, and is not limited to the time in Table 2. The intermediate annealing condition is not limited to the temperature and time in Table 2, but may be within the range of a typical operating condition.

The surface state of each obtained aluminum foil sample was observed with a scanning electron microscope to measure the surface area of the aluminum particles. The surface condition was observed with an optical microscope, and the surface area of the crystallized products and the average surface area per crystallized product were measured. In order to evaluate the surface irregularities of each aluminum foil sample, surface roughness Ra and surface roughness $R_{ZJIS}$ in the width (TD) direction perpendicular to the rolling direction were measured based on the observation with the atomic force microscope.

For Examples 8 to 10 and Comparative Example 15, after the surface washing, the protective layer was formed on one of the surfaces having the largest surface area.

For Example 8, the material constituting the protective layer was made of a silicon oxide (Glaska T2202A and T2202B produced by JSR Corporation, specifically 10 parts of T2202B mixed in 30 parts of T2202A). For Example 9, the material constituting the protective layer was an amorphous silicone composition (SP Clear HT produced by Ceramic Coat Co., Ltd.). For Example 10, the material constituting the protective layer was fluororesin (FPG-TA 001 produced by NIPPONPAINT Co., Ltd.). For each of Examples 8 to 10, the protective layer was formed by coating each of the above materials using a spin coater (Spin Coater MS-A150 produced by MIKASA Co., Ltd.). Specifically, each of the above materials was diluted with a solvent such that a solid content concentration became less than or equal to 10%, and three kinds of coating agents were prepared. Subsequently, each coating agent was applied to each of Examples 8 to 10 using the spin coater. The coating conditions were set such that the final film thickness of the protective layer became 70 nm, specifically, the rotation speed was set greater than or equal to 500 rpm and less than or equal to 7000 rpm, and the rotation time was set to 10 seconds. Subsequently, each of Examples 8 to 10 was fired at 180° C. for 1 minute. As a result, Examples 8 to 10 were prepared.

For Comparative Example 15, the material constituting the protective layer was made of an aluminum oxide. Specifically, after the surface washing, Comparative Example 15 was subjected to anodizing in a sulfuric acid bath. Subsequently, sealing was performed on Comparative Example 15 subjected to the anodizing.

For each of the obtained samples of Examples 8 to 10 and Comparative Example 15, surface roughness Ra was measured based on the observation with the atomic force microscope in order to evaluate the surface irregularities of the protective layer.

The total reflectance of the aluminum foils of Examples 1 to 10 and Comparative Examples 1 to 15 to the ultraviolet light was measured in order to evaluate the reflection characteristic. These measurement methods will be described below.

In the scanning electron microscope observation, the surface of the aluminum foil was observed with a secondary electron image at a magnification of 2000 times using JSM-5510 produced by JEOL Ltd. The aluminum particles pressed into or adhering to the surface of the aluminum foil and the aluminum base were binarized from an obtained surface observation image in the rectangular visual field of 64 μm×48 μm to measure the surface area of all the aluminum particles existing in the visual field. The ratio of the total surface area of all aluminum particles to the surface area of the visual field was calculated from the measured surface area of the individual aluminum particles and the surface area of the visual field. In the surface observation image, five points near a central portion in the width direction of the sample were taken and an average value of the five points for the ratio of the total surface area of the aluminum particles (Al particles) was calculated in each visual field. Table 3 illustrates the average value of the five points.

In the optical microscope observation, the surface of the aluminum foil was observed at a magnification of 500 times using ECLIPSE L200 produced by Nikon Corporation. The crystallized products and the aluminum base were binarized from the obtained surface observation image in a rectangular visual field of 174 μm×134 to measure the surface area of all the crystallized products existing in the visual field. The ratio of the total surface area of all the crystallized products to the surface area of the visual field was calculated from the measured surface area of the individual crystallized product and the surface area of the visual field. The average surface area per crystallized product was calculated from the measured surface area of the individual crystallized product and the number of crystallized products observed in the visual field. In the surface observation image, five points near the central portion in the width direction of the sample were taken and an average value of the five points for the ratio of the total surface area of the crystallized products was calculated in each visual field. Table 3 illustrates the average value of the five points. Although strictly a possibility that precipitate exists in the visual field cannot be denied, in the description, all the intermetallic compounds observed in the visual field are assumed to be the crystallized product.

In the surface irregularity observation with the atomic force microscope, the surface shape was observed using a scanning probe microscope AFM 5000 II produced by Hitachi High-Tech Science Corporation in the rectangular visual field of 80 μm×80 μm by a dynamic force mode system (non-contact). Regarding the obtained observation result, an inclination of the sample was corrected by tertiary curved surface automatic correction in which a curve surface was obtained by least squares approximation to perform fitting, and surface roughness Ra and surface roughness $R_{ZJIS}$ in the width (TD) perpendicular to the rolling direction were measured. Surface roughness Ra is a value calculated by extending arithmetic average roughness Ra defined in JIS B 0601 (2001 version) and ISO 4287 (1997 version) to three dimensions in order to apply the arithmetic average roughness Ra to the observed whole surface. In surface roughness $R_{ZJIS}$ in the width (TD) direction, two-dimensional surface roughness $R_{ZJIS}$ in a section along any width (TD) direction in the same visual field was measured by an evaluation method based on JIS B 0601 (2001 version) and ISO 4287 (1997 version). Table 3 illustrates surface roughness Ra, $R_{ZJIS}$ of the aluminum foil (Al foil).

The film thickness of the protective layer was measured with Filmetrics F20 produced by VITEC GLOBAL ELECTRONICS CO., LTD. A reflectance spectrum in a wavelength range of 400 nm to 1100 nm was obtained from the reflected light obtained by irradiating the surface of the protective layer with visible light. The film thickness at which a degree of coincidence between the reflectance spectrum and a theoretical reflectance spectrum becomes greater than or equal to 95% is defined as the film thickness of the protective layer.

Surface roughness Ra of the protective layer was measured with the atomic force microscope similarly to surface roughness Ra of the aluminum foil described above. In the surface irregularity observation with the atomic force microscope, the surface shape was observed using a scanning probe microscope AFM 5000 II produced by Hitachi High-Tech Science Corporation in the rectangular visual field of 80 μm×80 μm by a dynamic force mode system (non-contact). Regarding the obtained observation results, the inclination of the sample was corrected by the tertiary curved surface automatic correction in which the curve surface was obtained by the least squares approximation to perform the fitting, and surface roughness Ra was measured. Surface roughness Ra is a value calculated by extending arithmetic average roughness Ra defined in JIS B 0601 (2001 version) and ISO 4287 (1997 version) to three dimensions in order to apply the arithmetic average roughness Ra to the observed whole surface. Table 3 illustrates surface roughness Ra of the protective layer.

Using a UV white visible spectrophotometer V570 produced by JASCO Corporation, the total reflectance of an integrating sphere was measured in the wavelength range of 250 nm to 2000 nm with a standard white plate for integrating sphere produced by Labsphere, Inc. as a reference. The average value of ultraviolet light in the wavelength range of 250 nm to 400 nm and the average value of ultraviolet light in the wavelength range of 254 nm to 265 nm were obtained from the obtained total reflectance. The total reflectance was measured in the rolling direction (MD) and the direction (TD) perpendicular to the rolling direction, and the total reflectance was evaluated as the average value of the rolling direction (MD) and the direction (TD). Table 3 illustrates the average value of these total reflectances.

TABLE 3

| | | | Al particles | Crystallized products | | Al foil surface roughness | | Protective layer | Reflection characteristic (%) | |
|---|---|---|---|---|---|---|---|---|---|---|
| Sample number | Composition | Thickness (μm) | Total surface area (%) | Total surface area (%) | Average surface area (μm$^2$) | Ra (nm) | TD direction $Rz_{JIS}$ (nm) | surface roughness Ra (nm) | 254 nm to 265 nm | 250 nm to 400 nm |
| Example 1 | A | 30 | 0.03 | 0.02 | 0.6 | 8.1 | 53.6 | — | 84.6 | 87.5 |
| Example 2 | A | 100 | 0.02 | 0.02 | 0.6 | 6.9 | 41.3 | — | 83.0 | 86.6 |
| Example 3 | A | 150 | 0.03 | 0.02 | 0.6 | 11.0 | 60.2 | — | 83.1 | 86.2 |
| Example 4 | A | 230 | 0.04 | 0.02 | 0.6 | 11.4 | 67.5 | — | 84.7 | 87.3 |
| Example 5 | A | 100 | 0.00 | 0.02 | 0.6 | 12.0 | 76.7 | — | 84.6 | 87.1 |
| Example 6 | B | 15 | 0.04 | 1.5 | 0.7 | 11.3 | 66.2 | — | 81.9 | 86.5 |
| Example 7 | C | 40 | 0.03 | 1.8 | 1.2 | 15.5 | 69.2 | — | 82.5 | 85.5 |
| Example 8 | A | 30 | 0.03 | 0.02 | 0.6 | 8.1 | 53.6 | 5.0 | 81.7 | 84.4 |
| Example 9 | A | 100 | 0.02 | 0.02 | 0.6 | 6.9 | 41.3 | 3.8 | 80.3 | 81.9 |
| Example 10 | A | 100 | 0.02 | 0.02 | 0.6 | 6.9 | 41.3 | 4.9 | 80.1 | 81.7 |
| Comparative Example 1 | C | 80 | 0.01 | 1.5 | 0.7 | 20.0 | 100.3 | — | 78.4 | 82.5 |
| Comparative Example 2 | C | 20 | 0.02 | 1.8 | 1.2 | 45.2 | 195.1 | — | 79.3 | 81.9 |
| Comparative Example 3 | A | 100 | 0.06 | 0.02 | 0.6 | 7.2 | 45.7 | — | 76.8 | 82.4 |
| Comparative Example 4 | A | 100 | 0.15 | 0.02 | 0.6 | 7.4 | 41.7 | — | 73.3 | 79.6 |
| Comparative Example 5 | A | 100 | 0.94 | 0.02 | 0.6 | 8.0 | 51.8 | — | 65.5 | 73.8 |
| Comparative Example 6 | A | 30 | 0.59 | 0.02 | 0.6 | 6.5 | 46.5 | — | 77.7 | 83.3 |
| Comparative Example 7 | A | 230 | 1.96 | 0.02 | 0.6 | 11.9 | 78.4 | — | 76.3 | 81.5 |
| Comparative Example 8 | A | 150 | 2.95 | 0.02 | 0.6 | 13.4 | 56.5 | — | 66.3 | 74.2 |
| Comparative Example 9 | D | 150 | 0.04 | 3.3 | 4.0 | 11.6 | 57.2 | — | 73.7 | 80.0 |
| Comparative Example 10 | E | 150 | 0.03 | 4.7 | 2.4 | 13.2 | 87.9 | — | 77.3 | 80.9 |
| Comparative Example 11 | C | 80 | 0.82 | 1.5 | 0.7 | 18.6 | 96.2 | — | 64.1 | 71.5 |
| Comparative Example 12 | D | 150 | 0.70 | 3.3 | 4.0 | 6.0 | 30.7 | — | 78.4 | 83.1 |
| Comparative Example 13 | E | 150 | 0.36 | 4.7 | 2.4 | 5.9 | 29.1 | — | 75.9 | 81.8 |
| Comparative Example 14 | C | 20 | 0.20 | 1.8 | 1.2 | 47.8 | 207.3 | — | 73.2 | 77.8 |
| Comparative Example 15 | A | 100 | 0.02 | 0.02 | 0.6 | 6.9 | 41.3 | 10.2 | 75.3 | 82.2 |

As can be seen from the results in Table 3, in the aluminum foils of Examples 1 to 10, the ratio of the total surface area of the aluminum particles pressed into or adhering to the region of 64 μm×48 μm on the surface of the aluminum foil to the area of the region was less than or equal to 0.05%, the ratio of the total surface area of the crystallized products existing in the region of 174 μm×134 μm to the area of the region was less than or equal to 2%, the average surface area per crystallized product was less than or equal to 2 μm$^2$, and surface roughness Ra in the visual field of 80 μm×80 μm was less than 20 nm. In the aluminum foils of Examples 1 to 10, surface roughness $R_{ZJIS}$ in the TD direction was less than or equal to 100 nm.

It was confirmed that, in the aluminum foils of Examples 1 to 10, the total reflectance to the deep ultraviolet light in the wavelength range of 254 nm to 265 nm was greater than or equal to 80%, and that the aluminum foils of Examples 1 to 10 had the high reflectance to the deep ultraviolet light. It was also confirmed that, in the aluminum foils of Examples 1 to 7, the total reflectance to the ultraviolet light in the wavelength range of 250 nm to 400 nm was as high as greater than or equal to 85%, and that the aluminum foils of Examples 1 to 7 had the high reflection characteristic not only in the wavelength range of the deep ultraviolet light but also in the wide wavelength range of the ultraviolet light. It was also confirmed that, in the aluminum foils of Examples 8 to 10, the total reflectance to the ultraviolet light in the wavelength range of 250 nm to 400 nm was as high as greater than or equal to 80% despite the formation of the protective layer, and that the aluminum foils of Examples 8 to 10 had the high reflection characteristic not only in the wavelength range of the deep ultraviolet light but also in the wide wavelength range of the ultraviolet light.

On the other hand, in the aluminum foils of Comparative Examples 1 to 15, at least one of the ratio of the total surface area of the aluminum particles pressed into or adhering to the region to the surface area of the region of 64 μm×48 μm, the ratio of the total surface area of the crystallized product present in the region to the area of the region of 174 μm×134 μm, and surface roughness Ra was out of the above range. In the aluminum foils of Comparative Examples 1 to 14, it was confirmed that the total reflectance to the deep ultraviolet light in the wavelength range of 254 nm to 265 nm was as low as less than 80%. In the aluminum foils of Comparative Examples 1 to 14, it was confirmed that the total reflectance not only to the deep ultraviolet light but also to the ultraviolet light in the wavelength range of 250 nm to 400 nm was as low as less than 85%.

From the above results, it was found that the aluminum foil having the high reflectance, which was not conventionally made for the ultraviolet light, could be obtained by the present invention.

It should be considered that the disclosed embodiment and examples are illustrative and non-restrictive in every respect. The scope of the present invention is not limited to the above embodiment and examples, but is intended to be indicated by the scope of claims and includes the meaning equivalent to the scope to the claims and all modifications and variations within the scope.

INDUSTRIAL APPLICABILITY

The aluminum foil for ultraviolet light reflecting materials of the present invention can particularly advantageously be applied to ultraviolet-light reflecting materials used for sterilization of water or sea water, decomposition of organic materials, an ultraviolet light treatment, photocatalyst, and resin curing.

REFERENCE SIGNS LIST

1: aluminum foil, 10: rolled material, 11: cold-rolled material, 12: protective layer, 101, 102: rolling roll

The invention claimed is:

1. An aluminum foil for ultraviolet light reflecting materials, wherein a ratio of a total surface area of aluminum particles pressed into or adhering to a region having a predetermined surface area to a surface area of the region having the predetermined surface area is less than or equal to 0.05%, the region is a rectangular region of 174 μm×134 μm, a ratio of a total surface area of crystallized products existing in the region to the surface area of the region is less than or equal to 2% when all intermetallic compounds observed in the region are regarded as the crystallized products, an average surface area per crystallized product is greater than or equal to 0.6 $\mu m^2$ and less than or equal to 2 $\mu m^2$, an arithmetic mean surface roughness Ra of the region is less than 20 nm, a transfer stripe is formed on a surface of the aluminum foil, a ten-point mean surface roughness $R_{ZJIS}$ in a direction perpendicular to an extending direction of the transfer stripe is less than or equal to 76.7 nm, the aluminum foil for ultraviolet light reflecting materials comprises a protective layer formed on the region, and an average value of (i) a total reflectance measured in an extending direction of a surface of the protective layer to deep ultraviolet light in a wavelength range of 254 nm to 265 nm inclusive and (ii) a total reflectance measured in a direction perpendicular to the extending direction of the surface of the protective layer to the deep ultraviolet light in the wavelength range of 254 nm to 265 nm inclusive is greater than or equal to 80%.

2. The aluminum foil for ultraviolet light reflecting materials according to claim 1, wherein a thickness of the aluminum foil is greater than or equal to 4 μm and less than or equal to 300 μm.

3. The aluminum foil for ultraviolet light reflecting materials according to claim 1, wherein a material constituting the protective layer contains at least one of a silicone composition and a fluororesin.

4. The aluminum foil for ultraviolet light reflecting materials according to claim 1, wherein the surface of the protective layer has an arithmetic mean surface roughness Ra of less than or equal to 10 nm.

5. An aluminum foil for ultraviolet light reflecting materials, wherein a ratio of a total surface area of aluminum particles pressed into or adhering to a region having a predetermined surface area to a surface area of the region having the predetermined surface area is less than or equal to 0.05%, the region is a rectangular region of 174 μm×134 μm, a ratio of a total surface area of crystallized products existing in the region to the surface area of the region is less than or equal to 2% when all intermetallic compounds observed in the region are regarded as the crystallized products, an average surface area per crystallized product is greater than or equal to 0.6 $\mu m^2$ and less than or equal to 2 $\mu m^2$, an arithmetic mean surface roughness Ra of the region is less than 20 nm, the aluminum foil has (i) an Si content of greater than or equal to 0.001 mass % and less than or equal to 0.3 mass %, (ii) an Fe content of greater than or equal to 0.416 mass % and less than or equal to 0.5 mass %, or (iii) a combination thereof, a transfer stripe is formed on a surface of the aluminum foil, a ten-point mean surface roughness $R_{ZJIS}$ in a direction perpendicular to an extending direction of the transfer stripe is less than or equal to 76.7 nm, the aluminum foil for ultraviolet light reflecting materials comprises a protective layer formed on the region, and an average value of (i) a total reflectance measured in an extending direction of a surface of the protective layer to deep ultraviolet light in a wavelength range of 254 nm to 265 nm inclusive and (ii) a total reflectance measured in a direction perpendicular to the extending direction of the surface of the protective layer to the deep ultraviolet light in the wavelength range of 254 nm to 265 nm inclusive is greater than or equal to 80%.

* * * * *